United States Patent [19]

Fluck et al.

[11] 3,930,572

[45] Jan. 6, 1976

[54] APPARATUS FOR SEPARATING A SERIES OF OBJECTS

[75] Inventors: René Fluck; Franz Rüegg, both of Neuhausen am Rheinfall, Switzerland

[73] Assignee: SIG Schweizerische Industrie-Gesellschaft, Neuhausen am Rheinfall, Switzerland

[22] Filed: July 29, 1974

[21] Appl. No.: 492,921

[30] Foreign Application Priority Data

July 27, 1973 Switzerland ..... 11008/73

[52] U.S. Cl. ..... 198/34; 198/29

[51] Int. Cl.[2] ..... B65G 47/26

[58] Field of Search ..... 198/34, 29, 24

[56] References Cited

UNITED STATES PATENTS

| | | | |
|---|---|---|---|
| 3,037,610 | 6/1962 | Morton et al. | 198/29 |
| 3,339,706 | 9/1967 | Arvidson | 198/34 |
| 3,734,266 | 5/1973 | Despres | 198/24 |
| 3,811,549 | 5/1974 | Preisig | 198/34 |
| 3,826,348 | 7/1974 | Preisig et al. | 198/34 |

*Primary Examiner*—James B. Marbert
*Attorney, Agent, or Firm*—Spencer & Kaye

[57] ABSTRACT

Apparatus for conveying a continuous series of flat items along a path while in an upright position and in contact with one another and for dividing the series of items into successive separate groups at the end of the conveying path by insertion of a separator member behind the last item of the group then being separated, with the separation into groups being facilitated by causing the end portion of the conveying path, which carries the items being separated into a group, to be pivotal about an axis transverse to the conveying direction and lying in the plane of insertion movement of the separator member, and by constituting the separator member of a first component movable only perpendicularly to the fixed portion of the conveying path for retaining the items upstream of the group being formed, and a second component movable perpendicularly to the end portion of the conveying path and pivotal therewith for engaging the last item of the group being formed.

7 Claims, 8 Drawing Figures

APPARATUS FOR SEPARATING A SERIES OF OBJECTS

BACKGROUND OF THE INVENTION

The present invention relates to an apparatus for separating, into individual groups, a series of upright flat contacting items arriving in a continuous line on the conveyor of a processing machine, particularly a packaging machine, by means of a separating pusher inserted between the items.

Various forms of apparatus of this type are known. When the movable separator of such a known system is guided in a rigid or unyielding manner, it can happen that a flat item, which may be a cookie, for example, will be contacted by the descending separator precisely in the center of its upper side and could thus be damaged even if this upper side has a rounded configuration.

In order to avoid this drawback, it has been proposed to mount the separator on a movable carriage to be pivotal in the direction of advancement of the items and to provide spring means which hold the separator in its centered position. This type of apparatus has been found to be satisfactory if the item has a well rounded upper side. If the upper side of such an item is flat, however, it may occasionally be damaged in spite of the possibility for the lower edge of the separator to be deflected.

SUMMARY OF THE INVENTION

It is an object of the present invention to improve apparatus of the above-mentioned type to dependably permit entrance of the separator between two flat objects of a series of objects, regardless of whether their upper edges are rounded or flat.

The apparatus according to the invention is distinguished in that one end portion of the path, whose useful length corresponds to the length of the groups of items to be separated, is designed to be pivotal at least approximately in the plane of insertion movement of the separator about an axis which is transverse to the longitudinal direction of the path, and in that the separator is disposed above this axis and is composed of two parts, one part of the separator being movable, as a retaining member, only perpendicularly to the stationary path portion while the other part of the separator is movable perpendicularly to, and pivots with, the pivotal path portion.

This causes a wedge-shaped gap to appear between the objects disposed directly adjacent the pivot axis of the path when this path portion is being pivoted, with the separator entering into this gap.

DESCRIPTION OF THE PREFERRED EMBODIMENTS

Figure 1:
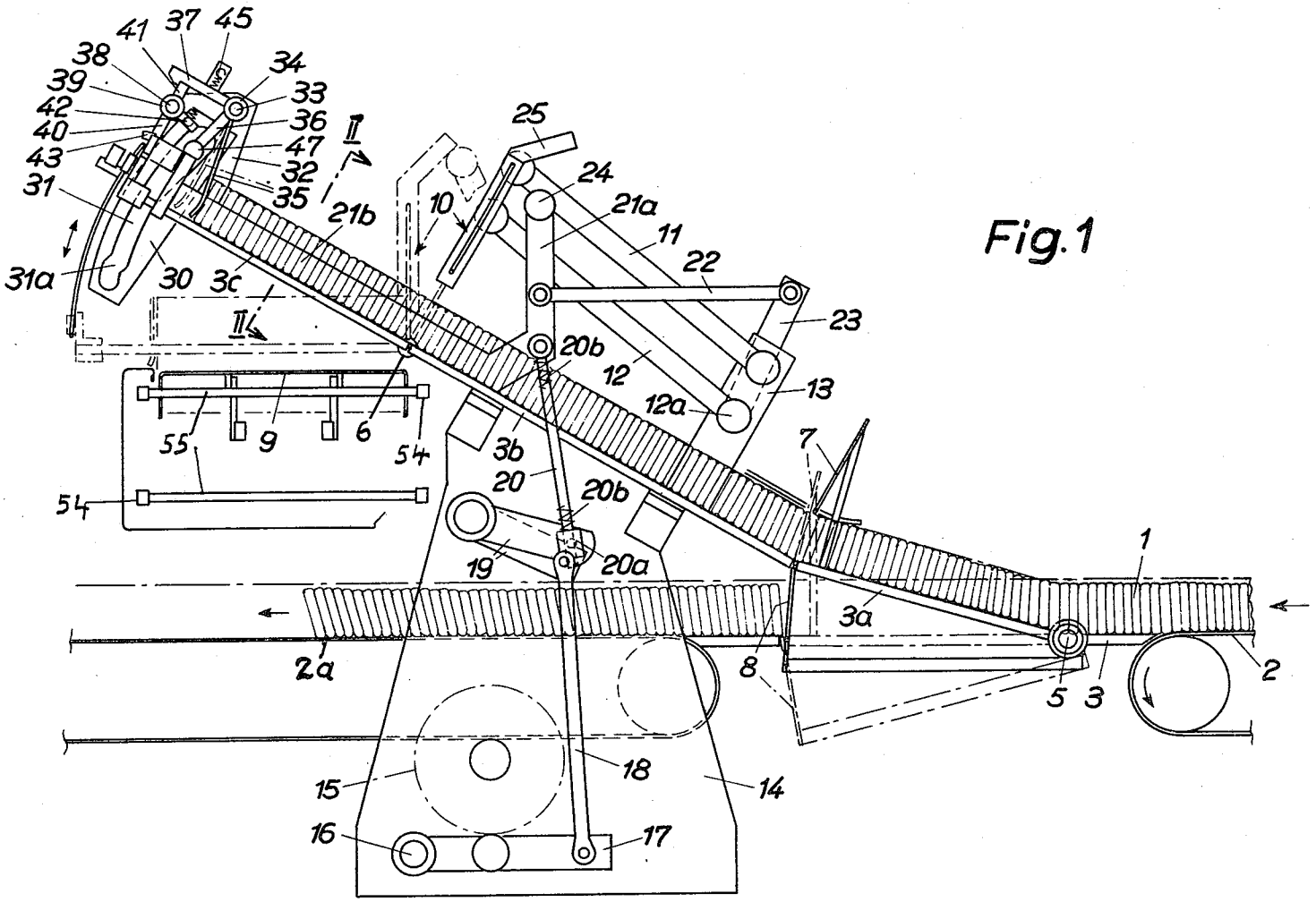
FIG. 1 is a side elevational view of a preferred embodiment of apparatus according to the invention for separating cookies arriving in a contiguous relationship into individual groups.
Figure 2:
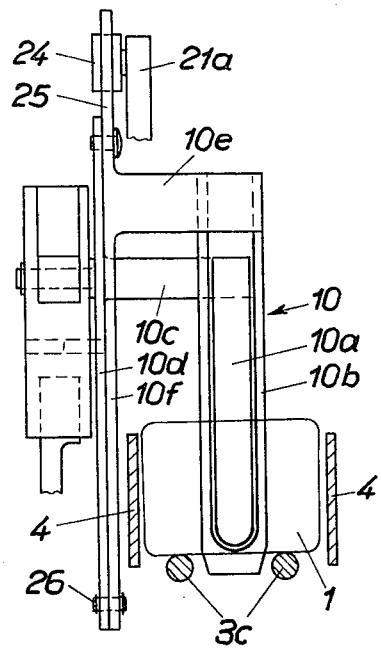
FIG. 2 is a cross-sectional view, to an enlarged scale, taken along line II—II of FIG. 1.
Figure 2:
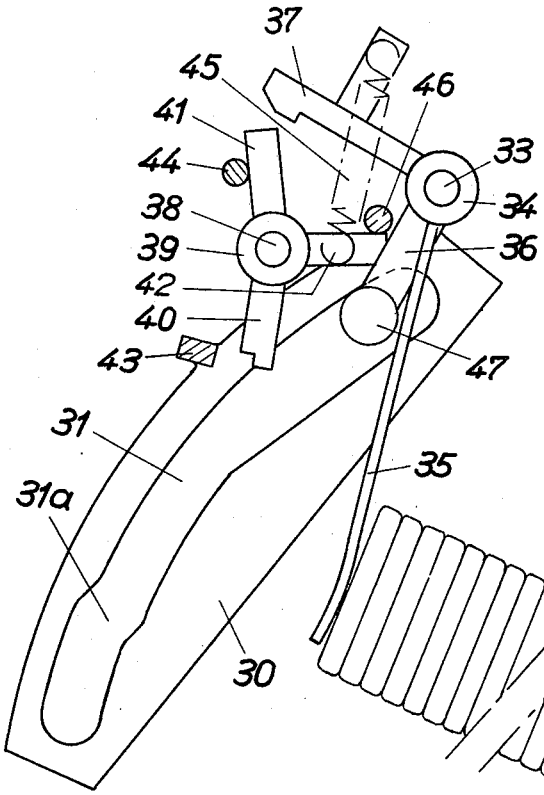

As shown generally in FIG. 1, a succession of cookies 1 arrive in an upright position and in a continuous line on a conveyor belt 2. They enter a path formed by two parallel series of rods 3, 3*a*, 3*b*, 3*c* and lateral guide walls 4, as shown in FIG. 2, which path goes obliquely upward. The path portions 3 and 3*b* are stationary. The path portions 3*a* and 3*c*, however, can pivot from their oblique position into a horizontal position about axes 5 and 6, respectively.

The pivotal path portion 3*a* does not relate to the present invention. It merely serves as a switch point to divert, in case of a malfunction in the subsequent path portion 3*b* or 3*c*, the continuously arriving cookies 1 to a further conveyor belt 2*a*, where they are deposited into a store or a receptacle. Retaining plates 7 and 8 are attached to path portion 3*a* in a known manner to prevent cookies which have already passed portion 3*a* from falling back onto the pivotal path portion 3*a* when the latter is being pivoted downwardly.

Figure 4:
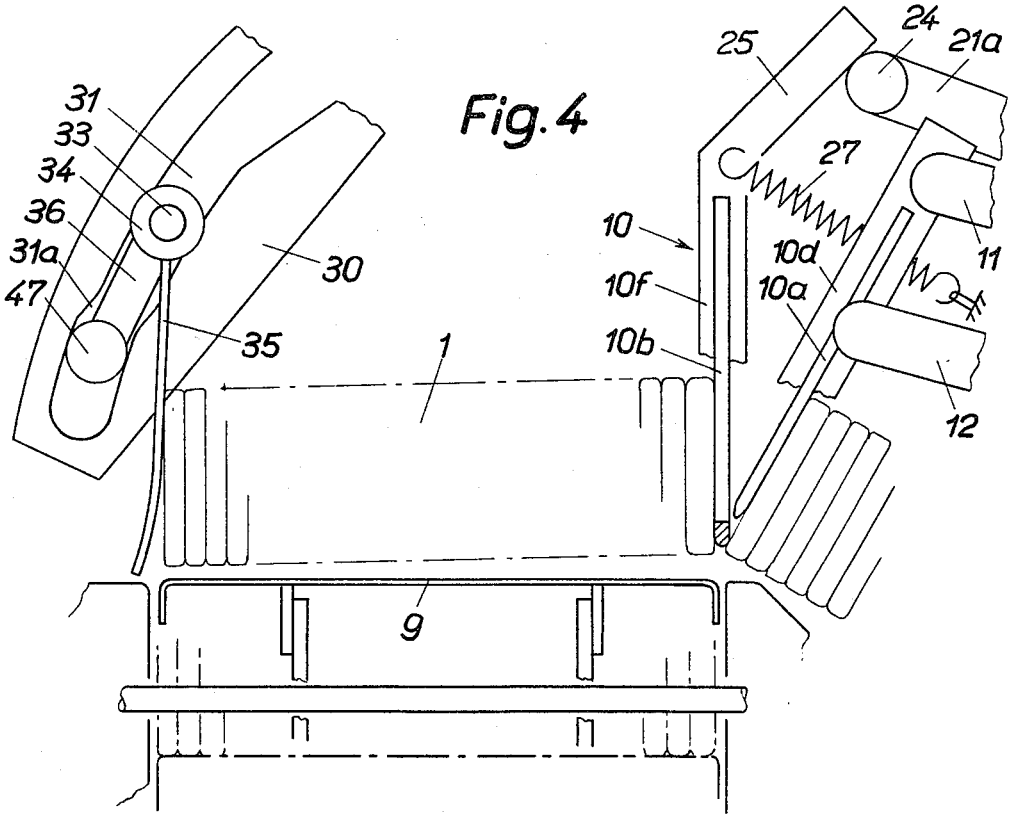

The second pivotal path portion, 3*c*, serves to separate the groups of cookies disposed thereon. Path portion 3*c* is pivotal from the oblique position shown in solid lines in FIG. 1 about the axis 6 into the horizontal position shown in dot-dash lines. When portion 3*c* reaches the horizontal position, the cookies thereon are transferred to a pusher 9 disposed therebelow and displaceable in a vertical direction. For this purpose the two rods 3*c* are moved away from one another on their pivotal support until the cookies are no longer being supported thereby and drop to the pusher 9. This pusher 9 then is lowered to such an extent that the cookies come under the control of a conveying system composed of rods 55 which are fastened between two rotating chains 54 and which advance the cookies to the next-following processing machine. Pusher 9 and the conveying device 54, 55 are known per se and are not directly related to the invention, and are therefore shown only schematically. FIG. 4 shows the path portion 3*c* in its lowered, or horizontal, position.

Figure 3:
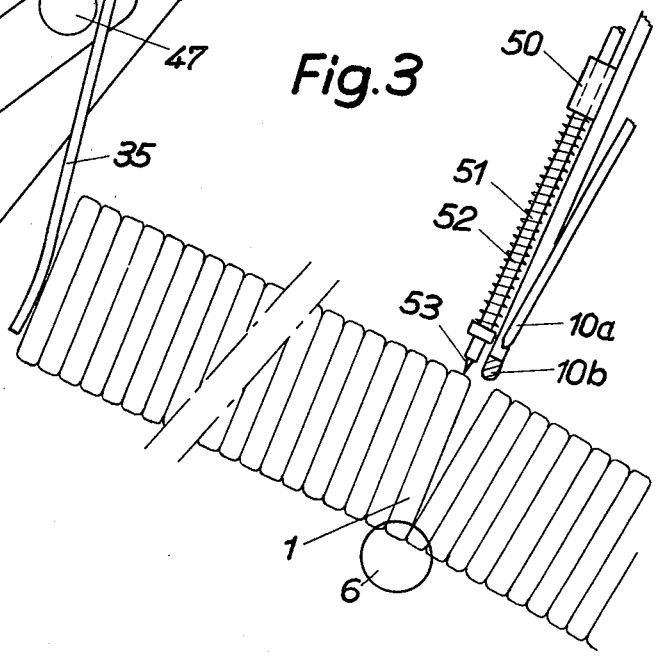
FIG. 3 and FIG. 4 are detail side views, to an enlarged scale, of a portion of the apparatus of FIG. 1 in different operating positions.

The separation of the cookies on path portion 3*c* from the immediately following cookies on path portion 3*b* is effected by a separator 10 which is shown schematically in FIG. 1 and in greater detail in FIGS. 2, 3 and 4. The pusher portions 10*a* and 10*b* entering between the cookies 1 are designed so that they can mesh completely in their basic position, shown in FIG. 2. The inner separator portion 10*a* is movable only at right angles to the path portion 3*b*, when the latter is in its oblique position, in a plane containing the pivot axis 6. This separator part 10*a* is pivotally linked by means of two parallel pivot arms 11 and 12 to a holder 13 disposed to one side of path portion 3*b*.

Path portion 3*b* is supported by a base 14 which carries a cam plate 15 connected with the drive for the entire apparatus (not shown). This cam plate 15 acts on the cam follower of a lever 17, which lever is pivotal about a stationary pin 16 and is connected via a rod 18, an intermediate lever 19, a sleeve 20*a* and a rod 20 with a two-armed lever 21*a*, 21*b* mounted to pivot about axis 6. Lever 17 is biassed to normally urge rod 18 upwardly. Rod 20 is mounted to be longitudinally displaceable in sleeve 20*a* and serves as a guide rod for a compression spring 20*b* which extends along substantially the entire length of rod 20. Rod 18 and sleeve 20*a* are pivotally connected to intermediate lever 19 and the pivotal movement of the intermediate lever 19 is thus transferred in a force-transmitting manner to the lever arm 21*a* by spring 20*b*.

If, as will be explained later, path portion 3*c* is blocked against pivoting, rotation of cam plate 15 to permit counterclockwise pivoting of lever 17 merely serves to compress spring 20*b*. Arm 21*b* is connected to pivotal path portion 3*c* in such a manner that the two members will rotate together. Arm 21*a* is connected with a lever 23 via a rod 22 and lever 23 is rigidly connected with pin 12*a* and thus with pivot arm 12. The path portion 3*c* is composed of two parallel rods which are rotatably connected to the levers 3*e;* the latter being pivotally linked by means of the axes 3*f* to a traverse 21*e*.

Figure 6:
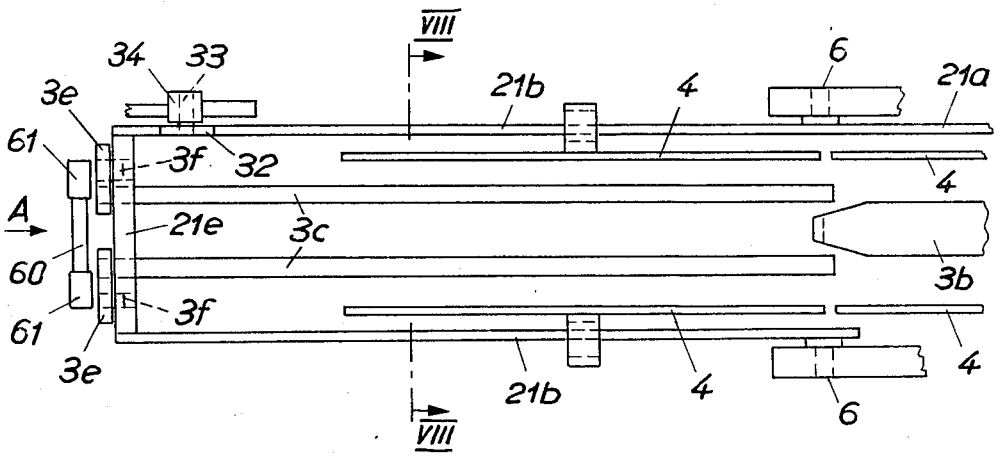
FIG. 6 is a horizontal projection of a portion of the apparatus.
Figure 7:
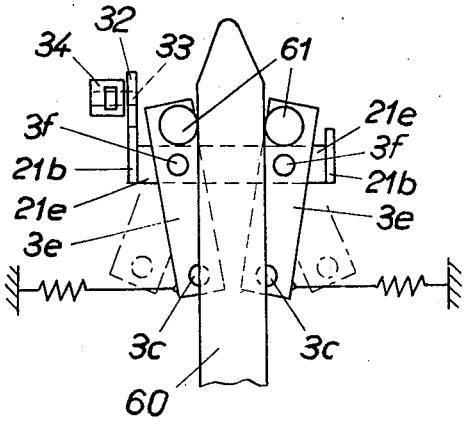
FIG. 7 is a view in the direction A of FIG. 6.
Figure 8:
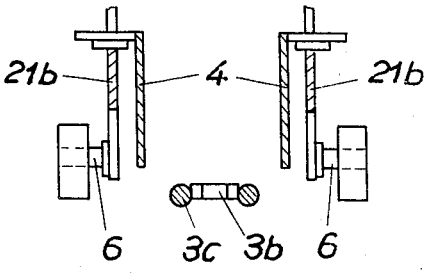
FIG. 8 is a cross-sectional view taken along line VIII—VIII of FIG. 6.

The traverse 21*e* is part of the arm 21*b* (FIGS. 6, 7). A control rod 60 serves to cause the levers 3*e* and thus the path portion 3*c* to pivot by means of rollers 21*a*.

As shown in FIG. 2, separator portion 10*a* is operatively connected with a lever 10*d* via a transverse arm 10*c*, lever 10*d* being disposed to one side of path portion 3*c*. Separator portion 10*b* is connected in a similar manner with a lever 10*f* via a transverse arm 10*e*. The two levers 10*d* and 10*f* are connected together by a pivot pin 26. Lever 10*f* is also provided with an extension 25 which points obliquely upwardly and away from the direction of conveyance of items 1. At the upper end of arm 21*a* there is disposed a roller 24 which cooperates with extension 25.

During one revolution of cam plate 15, which is indicated only schematically, path portion 3*c* will pivot into its horizontal position. At the same time, pivot arms 11 and 12 are moved to cause separator portion 10*a*, arm 10*c* and lever 10*d* to descend so that separator portions 10*a* and 10*b* move perpendicularly to the line of cookies and enter between the two adjacent cookies then located adjacent the boundary between path portions 3*b* and 3*c*. Separator part 10*b* with parts 10*e*, 10*f* and 25 is simultaneously pivoted about pin 26 by roller 24 so that separator part 10*b* will always remain perpendicular to the path portion 3*c*. The end positions of separator portions 10*a* and 10*b* are shown in FIG. 4, in which it can also be seen that part 25 is urged against roller 24 by a tension spring 27.

At the downstream end of the pivotal path portion 3*c* there is provided, as shown in detail in FIGS. 3 and 4, a stationary crank 30 provided with a cutout defining a curved path 31. A holder 32 (FIG. 1) in which a pin 33 is seated is connected to the pivotal path portion 3*c*. On this pin 33 an eye 34 is pivotally mounted and a sensor 35, a lever 36 and a latch 37 are fastened to eye 34. A further pin 38 is also mounted on holder 32 and an eye 39 is pivotally mounted on pin 38. Eye 39 carries three arms 40, 41 and 42.

The holder 32 is connected to the arm 21*b* as shown in FIG. 7, the connection between the arm 21*b* and the path portion 3*c* having been previously described.

Arm 42, which cooperates with an abutment 46, is fastened to a tension spring 45 whose other end is connected to latch 37. Arm 40 cooperates with an abutment 43 on the stationary crank 30. Arm 41 cooperates with latch 37 and with an abutment 44. The abutments 44 and 46 are fastened to holder 32 and to crank 30, respectively.

The apparatus operates as follows:

When path portion 3*c* is directed obliquely upward, latch 37 is latched into arm 41 and arm 40 is supported at abutment 43 so that path portion 3*c* is thus secured against pivoting. It remains thus secured until path portion 3*c* has been filled with cookies to the extent that the foremost cookie abuts at sensor 35 and displaces it to the position shown in dot-dash lines in FIG. 1. Thus latch 37 is pivoted and arm 41 is released. Spring 45 pivots the three-armed lever 40, 41, 42 until arm 41 rests against abutment 44 so that the contact between arm 40 and abutment 43 is released and path portion 3*c* can pivot downwardly.

At the end of lever 36 there is provided a roller 47 which is located in the cutout in crank 30 to move along the curved path 31. Sensor 35 is thus guided during pivoting of path portion 3*c* by lever 36 and its roller 47 so that the cookies are held between lever 36 and separator portion 10*b*. Only shortly before path portion 3*c* reaches the horizontal position, sensor 35 is moved somewhat toward the left by a bend 31*a* in the curved path 31. Thus the cookies are released so that during the subsequent spreading movement of the two rods 3*c* the cookies drop onto pusher 9, and are lowered to be thus transferred to the upper reach of the conveyor 54, 55. There they are engaged by the rods 55 connected between the two chains 54 and are pushed aside by pusher 9 shown in FIG. 4.

Path portion 3*c* then pivots back to its oblique position and near the end of this return movement, arm 42 of the three-armed lever engages abutment 46. The three-armed lever 40, 41, 42 could also be pivoted counterclockwise.

The arm 41 then comes into engagement with the head of the latch portion and slides therepast until during the further course of the rotation, latch 37 locks arm 41 under the influence of spring 45. After path portion 3*c* then drops back down by a few degrees, arm 40 will then again engage, and be supported on, abutment 43 so that a new operating cycle can begin.

Referring specifically to FIG. 3, a plunger 51 which is axially displaceable in a sleeve 50 can be arranged at separator portion 10*b* and pressed downwardly by a weak compression spring 52. Depending on the type and consistency of the objects 1, plunger 51 may be provided at the bottom with a pointed tip 53 or with a rubber cushion. The plunger serves to hold the last object of the group to be separated once the downward pivoting of path portion 3*c* begins. The spring path of plunger 51 must of course be greater than the penetration depth of separator part 10 so that insertion of the latter will not be impeded.

Figure 5:
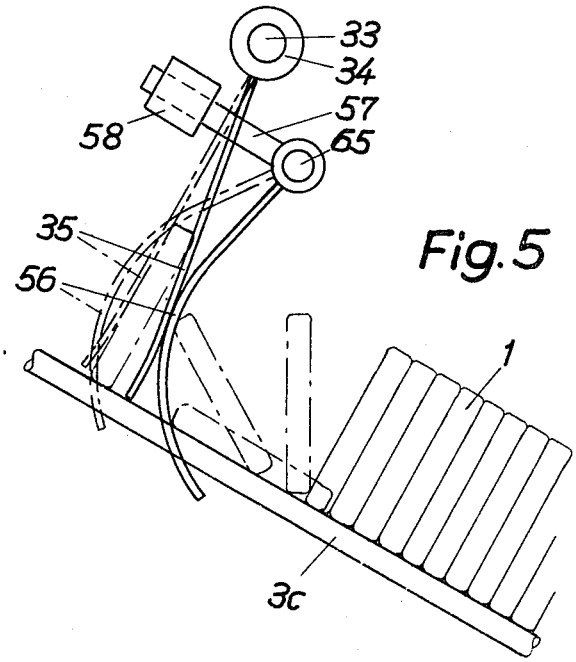
FIG. 5 is a side detail view of a modified form of a portion of the apparatus of FIG. 1.

FIG. 5 shows sensor 35 together with an additional device for raising into an upright position those objects 1 which have been conveyed in a prone position on path portion 3*c* toward sensor 35. Two levers 56 and 57 are pivotally mounted on a pin 65 which is fastened at mount 32. Lever 56 has a concave curvature shaped to cause objects which arrive in a prone position to be righted. Lever 57 is provided with a counterweight 58 which pushes lever 56 into the position shown in solid lines. Lever 56 is a forked member designed so that it can pivot backwards past, and adjacent both sides of, sensor 35 in order for the incoming line of objects to actuate the sensor 35 if the objects are upright. When sensor 35 is moved backward, by the foremost incoming object to the position shown in dot-dash lines, lever 56 is also moved back to the position shown in dot-dash lines.

In the illustrated embodiment actuation of the sensor 35 causes mechanical translation means to release the blocking of the pivotal path portion 3*c*. Instead of a mechanical translation it would of course also be possible to consider some other type of translation. Thus, for example, instead of the sensor lever 35 a position switch could be provided which influences a magnetic circuit. The arrangement would then have to be such that actuation of the position switch would cause the magnet to become active. The armature of the latter would then release arm 41 of the three-armed lever 40, 41, 42 so that spring 45 can pivot the lever and release the blocking engagement with abutment 43.

It will be understood that the above description of the present invention is susceptible to various modifications, changes and adaptations, and the same are intended to be comprehended within the meaning and range of equivalents of the appended claims.

We claim:

1. In apparatus for conveying a continuous series of flat items along a path while in an upright position and in contact with one another and for dividing the series of items into successive separate groups at the end portion of the conveying path by insertion of a separator member between the last item of the group being separated and the next succeeding item of the series, the improvement wherein said apparatus comprises: first conveying path means defining the end portion of said conveying path and having an effective length corresponding to the length of each group to be separated; second conveying path means disposed adjacent said first conveying path means and defining the portion of said conveying path immediately upstream of said end portion, said second conveying path means being fixed in position; means supporting said first conveying path means for pivotal movement about an axis transverse to the direction in which items are conveyed along said conveying path, the axis being at least approximately in the plane of insertion movement of the separator member; and wherein said separator member comprises: first separator means constituting a retaining member for the item next succeeding the last item of the group being separated and arranged for movement only in a direction perpendicular to the portion of said conveying path defined by said second conveying path means; and second separator means arranged for movement in a direction perpendicular to the portion of said conveying path defined by said first conveying path means and arranged to pivot together with said first conveying path means.

2. An arrangement as defined in claim 1 wherein said second conveying path means are obtained in an upwardly inclined manner and said first conveying path means are pivotal between such upwardly inclined orientation and a horizontal orientation.

3. An arrangement as defined in claim 1 wherein said second separator means is formed to present an opening in which said second separator means is disposed at least at the start of insertion movement of said separator member.

4. An arrangement as defined in claim 1 further comprising: sensor means disposed at the end of the path portion defined by said first conveying path means for sensing the arrival of an item at the end of that path portion; and latch means connected to said first conveying path means for normally preventing pivotal movement thereof and operatively associated with said sensor means to permit pivotal movement of said first conveying path means when said sensor means senses the arrival of an item.

5. An arrangement as defined in claim 4 wherein said sensor means comprise: a position switch disposed to be actuated by an item arriving at the end of the path portion defined by said first conveying path means; and a magnet having a movable armature, said magnet being operatively connected to move said armature when said position switch is actuated and said armature being connected to cause said latch means to release said first conveying path means when said armature is moved by said magnet.

6. An arrangement as defined in claim 4 further comprising: a concave, forked lever disposed in front of said sensor means and mounted to pivot away from the direction of movement of items on said conveying path, said forked lever being arranged to place upright an item arriving in a prone position at the end of said conveying path.

7. An arrangement as defined in claim 1 further comprising: a plunger mounted on said second separator means for pivotal movement with said second separator means and for movement relative thereto parallel to the direction of insertion movement of said separator member and located for holding the last item of the group being separated; and spring means arranged for urging said plunger toward such item.

* * * * *